US006810920B1

(12) United States Patent
Rolling

(10) Patent No.: US 6,810,920 B1
(45) Date of Patent: Nov. 2, 2004

(54) FUEL DRIP PREVENTION METHOD

(76) Inventor: James A. Rolling, 2103 Church St., Covington, GA (US) 30014

( * ) Notice: Subject to any disclaimer, the term of this patent is extended or adjusted under 35 U.S.C. 154(b) by 0 days.

(21) Appl. No.: 10/658,636

(22) Filed: Sep. 8, 2003

(51) Int. Cl.[7] ..... B65B 1/04; B65B 3/04

(52) U.S. Cl. ..... 141/1; 141/206; 141/311 A; 141/392; 222/110; 137/527

(58) Field of Search ..... 141/1, 206–226, 141/311 A, 392; 222/108–110; 137/511, 527

(56) References Cited

U.S. PATENT DOCUMENTS

| | | | | |
|---|---|---|---|---|
| 228,306 | A | 2/1880 | Williams | |
| 1,027,271 | A | 5/1912 | Duckworth et al. | |
| 2,004,203 | A | 6/1935 | Howell | 221/84 |
| 2,035,438 | A | 3/1936 | Warren | 221/84 |
| 2,207,285 | A | 4/1940 | Chapman | 221/84 |
| 2,578,926 | A | 12/1951 | Douglas | 226/127 |
| 3,074,427 | A | 1/1963 | Wheeler, Jr. | 137/512.1 |
| 3,498,322 | A | 3/1970 | Gilliam | 137/527.2 |
| 3,538,946 | A | 11/1970 | Hilsheimer | 137/512.1 |
| 3,612,098 | A | 10/1971 | Torrance et al. | 137/527 |
| 3,678,958 | A | 7/1972 | Satterwhite et al. | 137/512.1 |
| 3,817,277 | A | 6/1974 | Wheatly | 137/515.7 |
| 3,831,628 | A | 8/1974 | Kintner et al. | 137/512.15 |
| 3,923,425 | A | 12/1975 | Porter et al. | 417/298 |
| 3,933,173 | A | 1/1976 | Kajita | 137/527.8 |
| 3,965,926 | A | 6/1976 | Buckner | 137/512.1 |
| 4,005,732 | A | 2/1977 | Buckner | 137/512.1 |
| 4,043,358 | A | 8/1977 | Sliski | 137/512.1 |
| 4,063,570 | A | 12/1977 | Mitchell et al. | 137/454.2 |
| 4,196,745 | A | 4/1980 | Schutzer | 137/512.1 |
| 4,201,241 | A | 5/1980 | Schertler | 137/527 |
| 4,213,488 | A | 7/1980 | Pyle | 141/1 |
| 4,214,614 | A | 7/1980 | Pyle | 141/1 |
| RE30,532 | E | 3/1981 | Buckner | 137/512.1 |
| 4,257,444 | A | 3/1981 | Ogle, Jr. et al. | 137/315 |
| 4,445,533 | A | 5/1984 | DeFrees | 137/512.1 |
| 4,524,805 | A | 6/1985 | Hoffman | 137/846 |
| 4,694,853 | A | 9/1987 | Goodwin | 137/512.1 |
| 5,004,009 | A | 4/1991 | Bunce | 137/512.3 |
| 5,285,816 | A | 2/1994 | Herlihy | 137/856 |
| 5,377,729 | A | 1/1995 | Reep | 141/392 |
| 5,392,810 | A | 2/1995 | Cooper et al. | 137/512.1 |
| 5,603,364 | A | 2/1997 | Kerssies | 141/392 |
| 5,620,032 | A | 4/1997 | Dame | 141/311 A |
| 5,645,116 | A | 7/1997 | McDonald | 141/208 |
| 6,311,742 | B1 | 11/2001 | Nusen et al. | 141/206 |
| 6,520,222 | B2 | 2/2003 | Carmack et al. | 141/311 A |

OTHER PUBLICATIONS

"Circles, Angles & Arcs" Glencoe/McGraw Hill Geometry, Sections 9–1 & 9–2, www.e–zgeometry.com, Jul. 31, 2003, 2 pages.

"Class Curve", MySQL Manual section 11.2.7, http://mysql.inspire.net.nz, Jul. 31, 2003, 2 pages.

*Primary Examiner*—Timothy L. Maust
(74) *Attorney, Agent, or Firm*—Santangelo Law Offices, P.C.; Alfred K. Wiedman Jr.

(57) ABSTRACT

The novel use of a one-way valve (13) to prevent drips of fluid such as fuel from a fluid delivery conduit after an intended flow shut-off is disclosed. At least one embodiment involves the use of a biased, one way valve that is reconfigurably responsive to a fluid flow shut-off pressure to prevent flow (e.g., drips, drops and/or a fluid stream) after an intended shut-off of fluid flow via closing of a main valve element (5). The biased, one-way valve (13) may itself comprise at least one fluid obstruction element that is rotatable about and attached at a chord of a simple closed curve (a circle or oval, as but two examples) defined by the inner surface of the conduit through which fluid in the vicinity of the valve flows. Nozzles of existing fuel conduits may be retrofitted to include the valve, or initial manufacturing may incorporate the valve within the conduit.

64 Claims, 12 Drawing Sheets

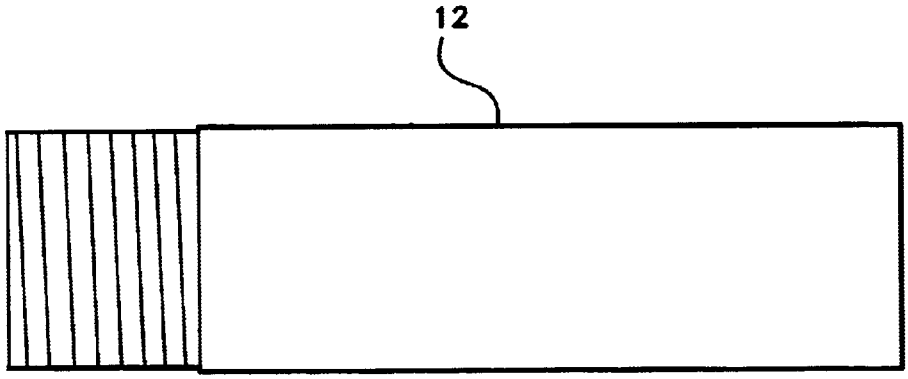
Fig. 9a
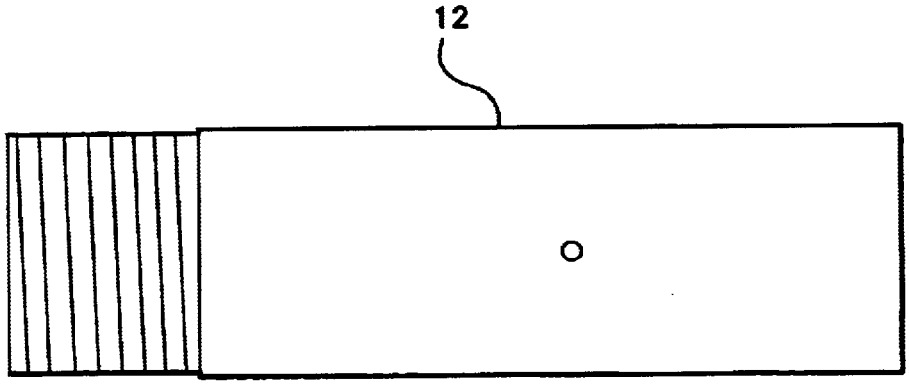
Fig. 9b
Fig. 9

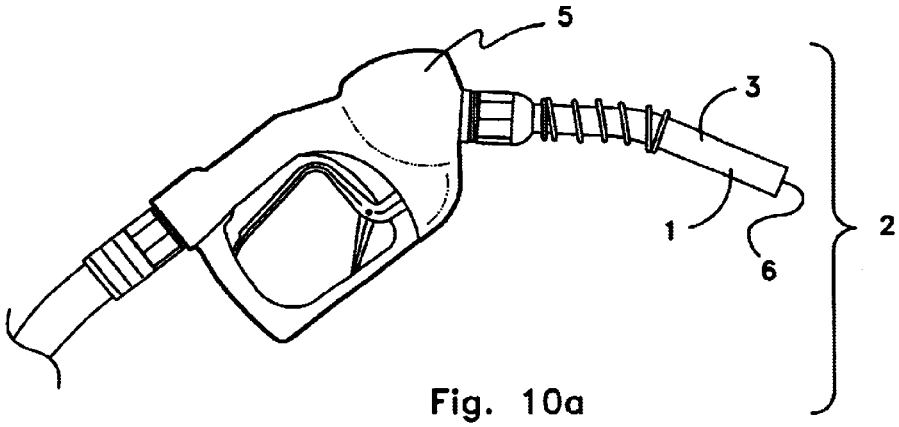
Fig. 10a
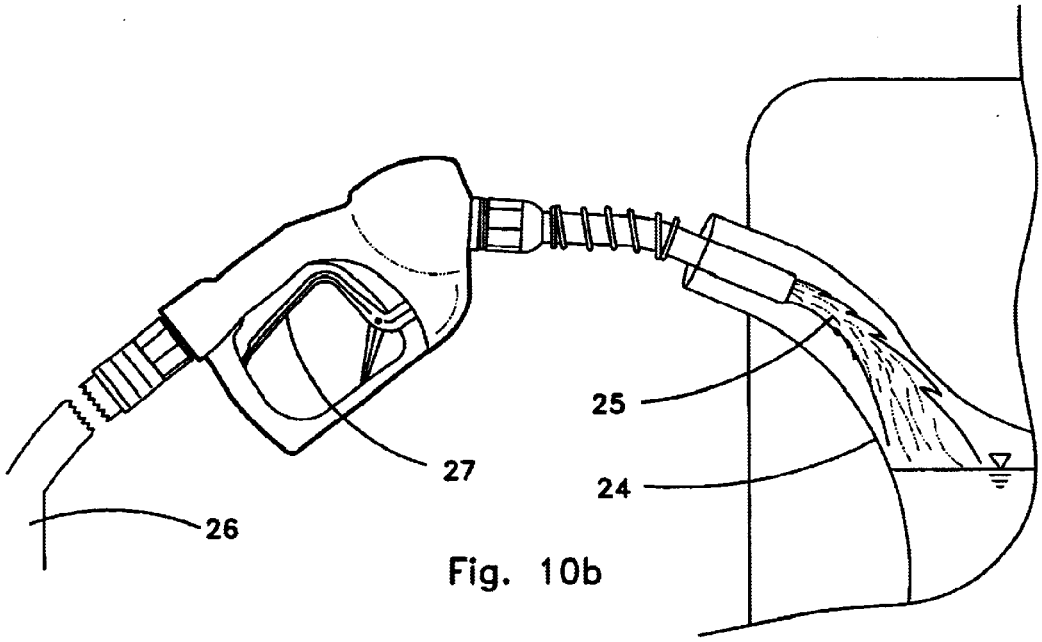
Fig. 10b
Fig. 10

FUEL DRIP PREVENTION METHOD

BACKGROUND OF THE INVENTION

Generally, this invention relates to a method for preventing unwanted flow in any form from exiting a nozzle after an intended termination of flow. Specifically, the preferred embodiment of the invention focuses on a method for preventing the unwanted release or discharge of fuel drips from a fuel pump or delivery nozzle after an intended fuel delivery shut-off, through the use of a biased, one-way valve that is reconfigurable in response to a fuel delivery termination pressure and that itself may comprise at least one fluid obstruction element that rotates about (and is perhaps attached at) an axis that is aligned with a chord of a simple closed curve defined by the inner surface of the fuel conduit.

The desire to prevent unintended flow from a conduit such as a fuel pump nozzle after a main flow has been intentionally terminated in some manner (e.g., by closure of a main valve element) has been known for some time. Preventing such flow, typically in the form of drips or drops, but certainly also observed as a stream of fluid at times, prevents unwanted spillage, reduces waste, results in a more volumetrically accurate filling procedure, reduces the total emanation of vapors from the fluid into the ambient environment, and generally, results in a more economical filling operation, among other things. The reduction in total emanation of vapors from the fluid into the ambient environment may result in significant benefits to the environment, and in health benefits to persons in that environment, particularly upon consideration of the high numbers of fuel pump nozzles and the vast amounts of gasoline that are pumped through them on any given day in certain areas. Such benefits of post flow delivery shut-off accrue to both the seller of the fluid, the operator of the fluid delivery device, and the purchaser of the fluid, and are particularly apparent when the delivered fluid is a fuel such as gasoline or diesel, e.g., and the conduit.

At least one other prior art apparatus such as that disclosed in U.S. Pat. No. 5,620,032 to Dame is directed to preventing drips specifically from fuel nozzles. However, Dame's disclosed device is not usable to block substantially all of the flow area of the fuel conduit because it discloses only a valve portion that is "nearly rectangular in shape", and thus unable to completely obstruct the disc-shaped flow area of the disclosed fuel conduit. Also contributing to this aspect of the operation of Dame's device is attachment of the disclosed valve portions along curved (instead of straight) sections, those curved sections being potions of the C-shaped ring(s). Such attachment prevents a more thorough blocking of the flow area and increases the possibility of unwanted passage of fuel around certain portions of the C-shaped ring to which no valve portion is attached, after a shut-off of the main flow. Such attachment might also inhibit facile rotation, as more resistance expectedly inheres in a rotation about a curved axis as compared with rotation about a straight axis.

There may indeed be known certain valve apparatus which is used in at least one embodiment of the instant invention's methods to effectively prevent unwanted "post intended flow shut-off" drips (a term including drops or any type of flow from the end of the relevant conduit). However, although such apparatus may be known (see, e.g. U.S. Pat. No. 4,005,732 and U.S. Pat. No. 3,965,926), their use to prevent flow from a fluid delivery conduit after an intended shut-off is riot. As these valves and the aforementioned "post intended flow shut-off" drip problem have been known for some time now; the fact that these valves have not yet been used to prevent "post intended flow shut-off" drips (including drops or any other unwanted flow such as stream flow) points to the non-obviousness of the present invention.

SUMMARY OF THE INVENTION

The present invention includes a variety of aspects which may be selected in different combinations based upon the particular application or needs to be addressed. In one basic form, the invention discloses the use of a known one-way valve in a novel manner to effectively prevent "post intended flow shut-off" drips, including drops or other flow from a fluid delivery conduit. A more focused embodiment of the invention is the use of a known one-way valve in a novel manner or application to prevent "post intended fuel flow shut-off" drips, drops or flow from a fuel delivery conduit. A preferred embodiment involves the use of a biased, one way valve that is reconfigurably responsive to a fluid flow shut-off pressure to prevent flow (e.g., drips, drops and/or a fluid stream) after an intended shut-off of fluid flow (this shut-off of fluid flow occurring via closing of a main valve element). The valve may comprise at least one fuel obstruction element that is rotatable about and/or attached at a chord of a simple closed curve (a circle or oval, as but two examples) defined by the inner surface of the fuel conduit, and in a preferred embodiment, the one way valve comprises two fuel obstruction elements rotatable about and attached at a respective chord of the simple closed curve. The two chords may be within a plane that is orthogonal to an axis of the fuel conduit, substantially collinear, and may bisect the simple closed curve. The valve may be retrofit within a conduit of an existing fuel nozzle, or a conduit extension (which includes the valve already, or within which the valve may be added) may be added to an existing conduit, so that an existing fuel nozzle may be drip-free during fuel delivery. Also, a factory adaptation is possible in which a non-extended conduit of the nozzle is adapted to incorporate the valve within it, or in which a conduit extension (which includes the valve already, or within which the valve may be added) is attached at the end of the non-extended conduit. Naturally, as a result of these several different and potentially independent aspects of the invention, the objects of the invention are quite varied.

One of the broad objects of at least one embodiment of the invention is to enable adaptation of existing fluid delivery conduits so that they may be operated with a decreased fluid flow out of a conduit end or opening occurring after an intended shut-off of a main valve element or other intended substantial termination of flow, as compared with that post-intended main flow shut-off or termination, drip release prevention (whether relative to a fuel pump nozzle or fuel container) effected by any prior art drip prevention valves.

One of the broad objects of at least one embodiment of the invention is to enhance the effectiveness of prevention of unwanted spillage of a fluid such as fuel from a fluid delivery conduit after an intended shut-off of a main valve element or other intended substantial termination of flow, as compared with any prior art drip prevention valves.

One of the broad objects of at least one embodiment of the invention is to reduce waste associated with unwanted spillage of a fluid such as fuel from a fluid delivery conduit after an intended flow termination. A related object of at least one embodiment of the present invention may be to enable cost savings for the seller and/or purchaser of fuel.

One of the broad objects of at least one embodiment of the invention is to effect a more volumetrically accurate filling procedure by substantially preventing flow of fluid such as fuel from a fluid delivery conduit after an intended flow termination, in an improved manner relative to any prior art drip prevention valves.

One of the broad objects of at least one embodiment of the invention is to reduce the emanation of vapors from the fluid into the ambient environment by substantially preventing flow of fluid such as fuel from a fluid delivery conduit after an intended flow termination. A related object of at least one embodiment of the invention is to improve the environment, particularly the air quality, and thus improve the health of persons inhaling that air.

One of the broad objects of at least one embodiment of the invention is to generally effect a more economical filling operation by substantially preventing flow of fluid such as fuel from a fluid delivery conduit after an intended flow termination in an improved manner relative to any prior art drip prevention devices.

One of the broad objects of at least one embodiment of the invention is to enable adaptation of existing, installed flow delivery conduits (including fuel pump nozzles and conduits of fuel conduits, as but two examples) by retrofitting, e.g., so that flow occurring after an intended fluid delivery shut-off (e.g., drips or drops, and/or a small stream) can be more effectively prevented without requiring a more costly purchase of, e.g., an entire fuel pump nozzle or fuel container, as compared with any prior art drip prevention devices. A related object of at least one embodiment of the present invention is to enable improved cost savings for the owner of the nozzle, savings which may be passed on to the purchaser of fluid, e.g., delivered via this nozzle.

One of the broad objects of at least one embodiment of the invention is to enable adaptation of flow delivery conduits in the factory so that the output product incorporates a fuel drip prevention valve element.

Naturally, further aspects and objects of the invention are disclosed throughout other areas of the specification and claims.

BRIEF DESCRIPTION OF THE DRAWINGS

FIGS. 9*a* and 9*b* are outer views of a fuel conduit extension of at least one embodiment of the invention.

FIGS. 10*a* and 10*b* are views of a fuel pump nozzle in a fuel conduit flow obstruction configuration and a fuel conduit flow configuration, respectively.

DETAILED DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should further be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
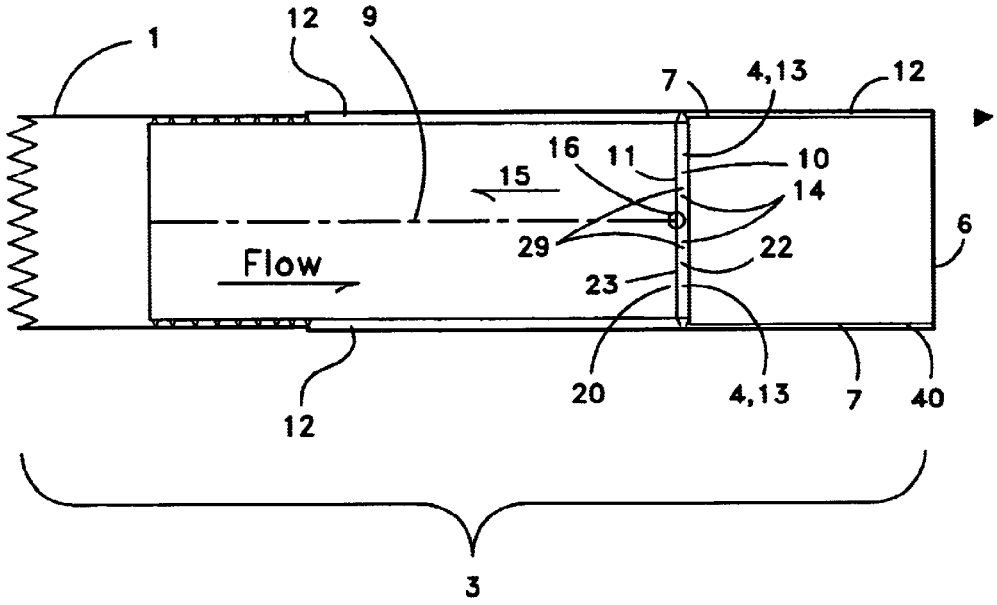
FIG. 1 is an axial cross-sectional view of an adapted fuel conduit in a fuel conduit flow obstruction configuration of at least one embodiment of the invention.
Figure 2:
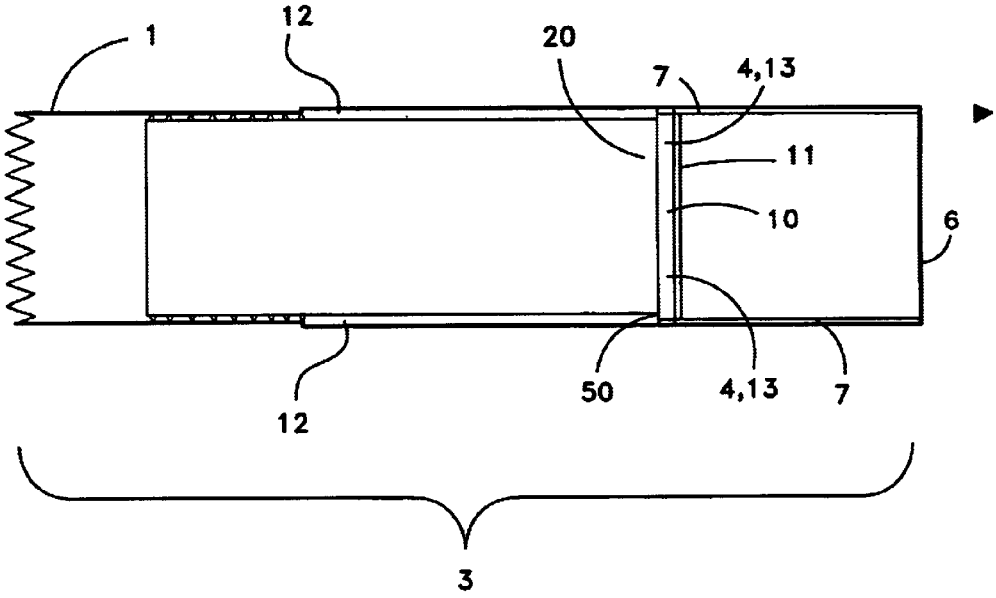
FIG. 2 is an axial cross-sectional view of an adapted fuel conduit in a fuel conduit flow obstruction configuration of at least one embodiment of the invention. The perspective of FIG. 2 is perpendicular to that perspective of FIG. 1.
Figure 3:
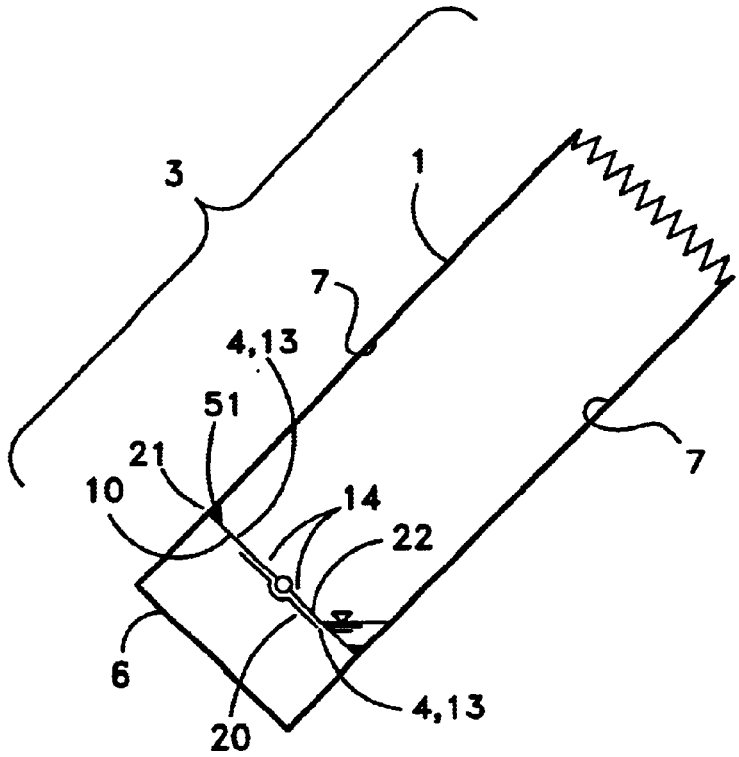
FIG. 3 is an axial cross-sectional view of an adapted fuel conduit in a fuel conduit flow configuration of at least one embodiment of the invention.
Figure 4:
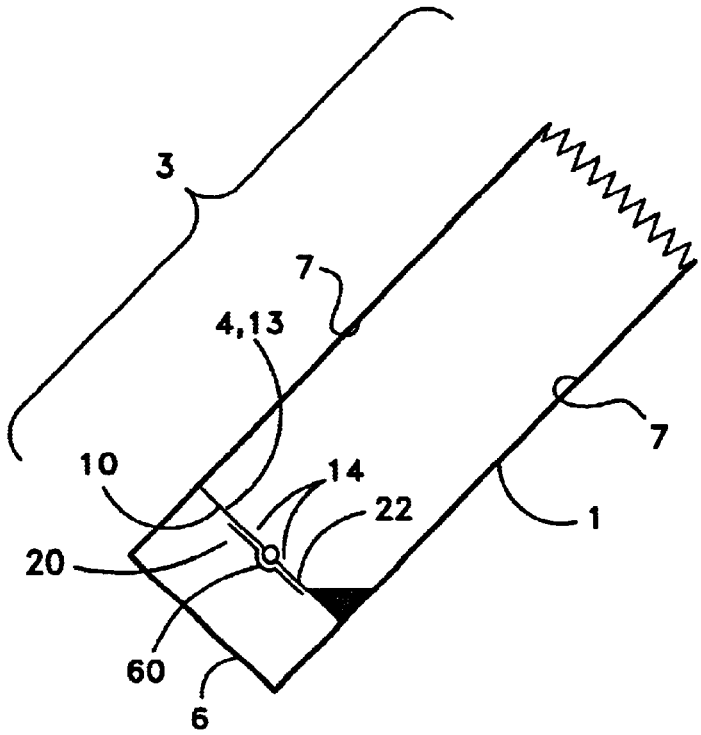
FIG. 4 is an upflow view of an adapted fuel conduit in a fuel conduit flow configuration from a terminal end of the adapted fuel conduit of at least one embodiment of the invention.
Figure 5:
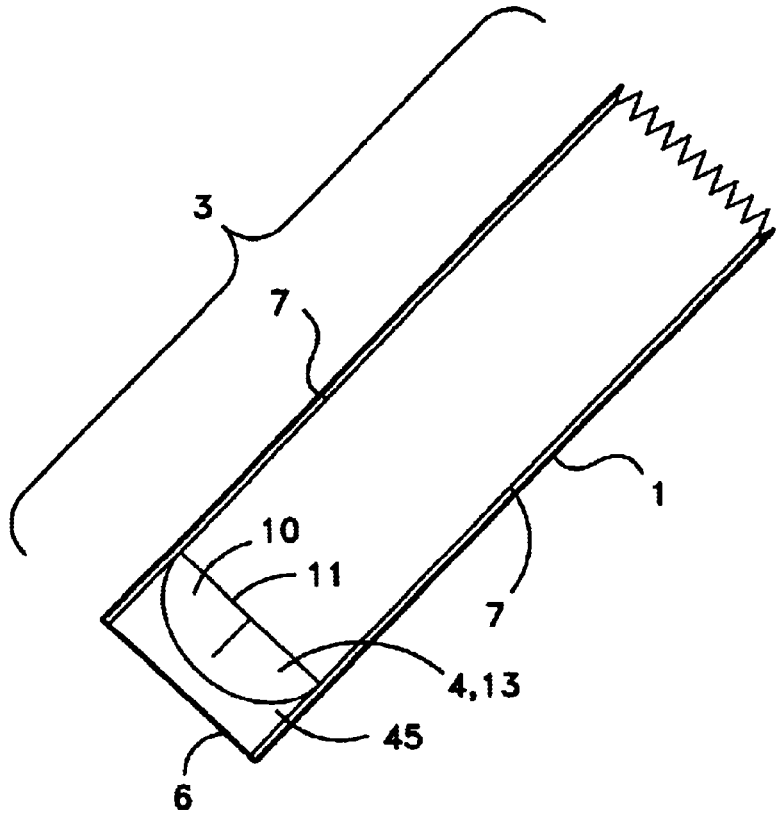
FIG. 5 is an upflow view of an adapted fuel conduit in a fuel conduit flow configuration from a terminal end of the adapted fuel conduit of at least one embodiment of the invention.
Figure 6:
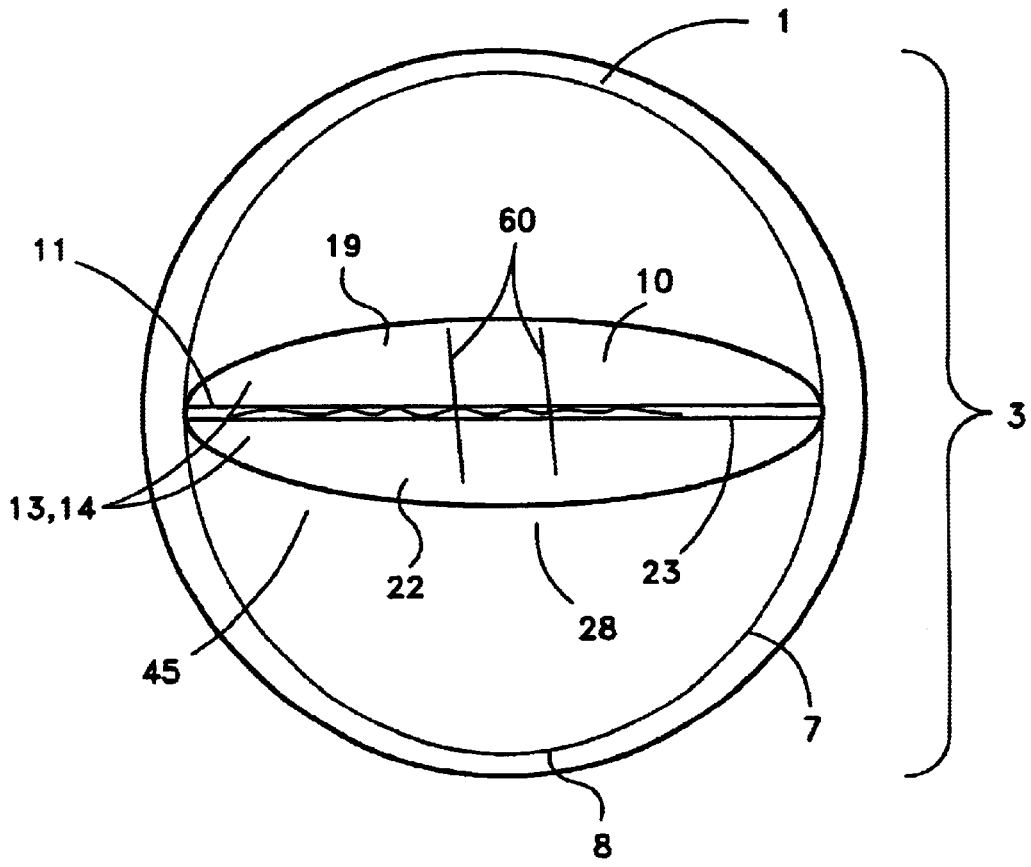
FIG. 6 is an axial cross-sectional view of an adapted fuel conduit in a fuel conduit flow obstruction configuration of at least one embodiment of the invention.
Figure 7:
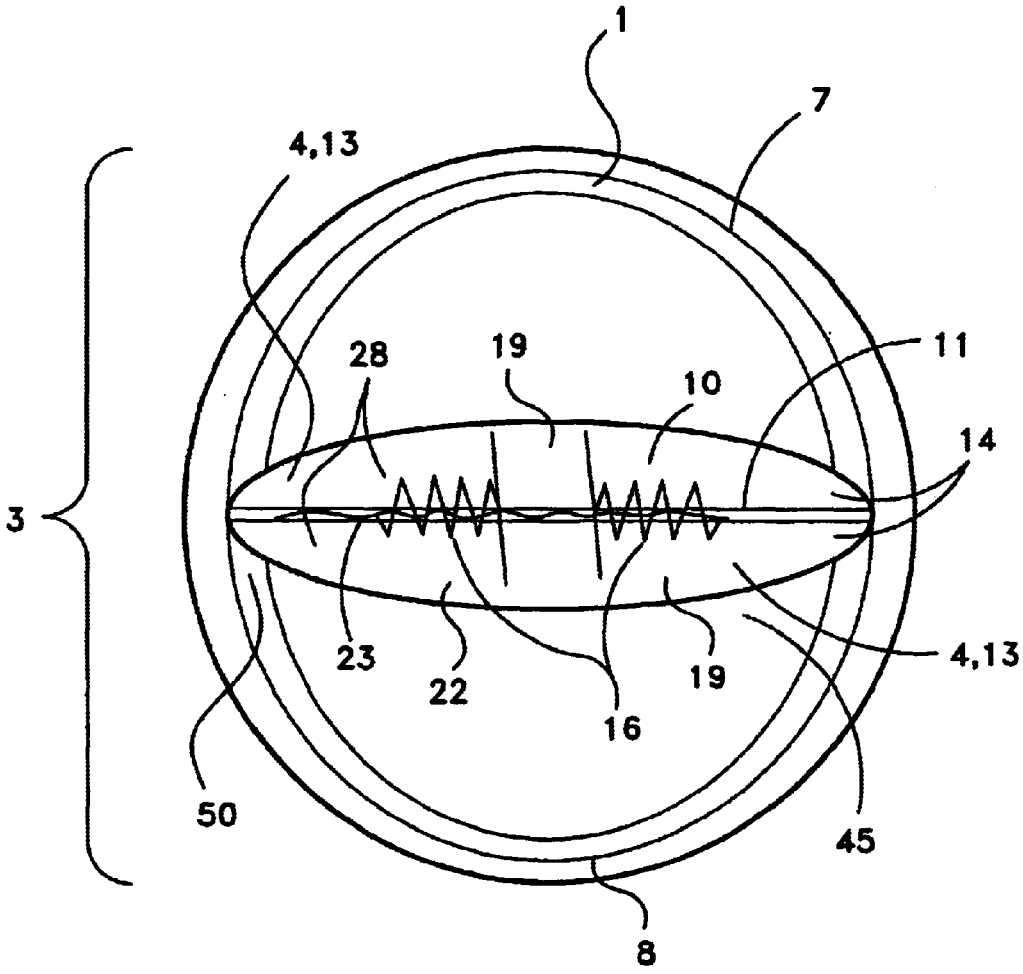
FIG. 7 is an axial cross-sectional view of an adapted fuel conduit in a fuel conduit flow obstruction configuration of at least one embodiment of the invention.
Figure 8:
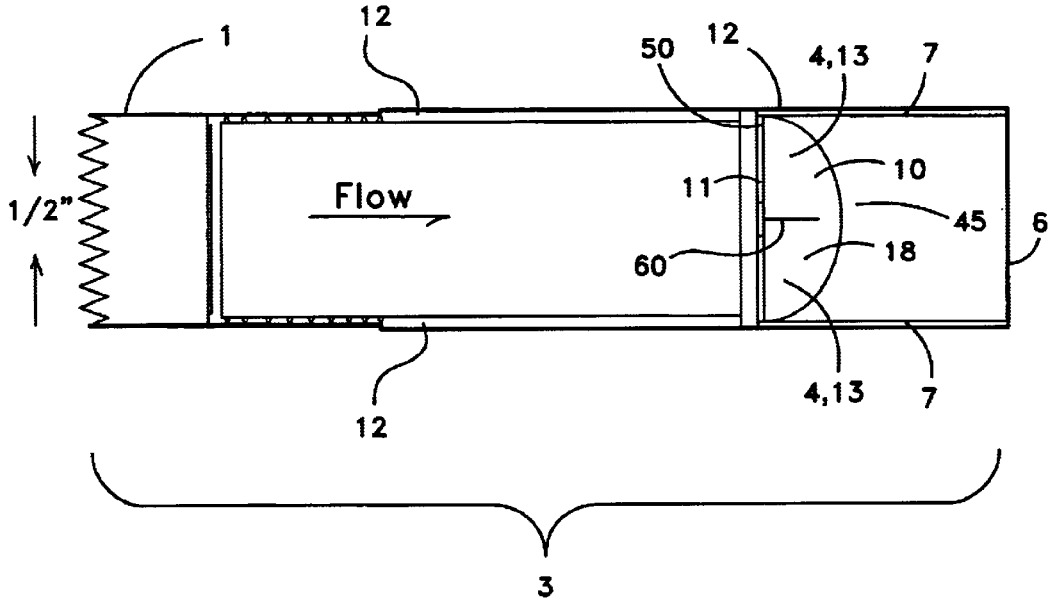
FIG. 8 is an axial cross-sectional view of an adapted fuel conduit in a fuel conduit flow configuration of at least one embodiment of the invention.
Figure 11:
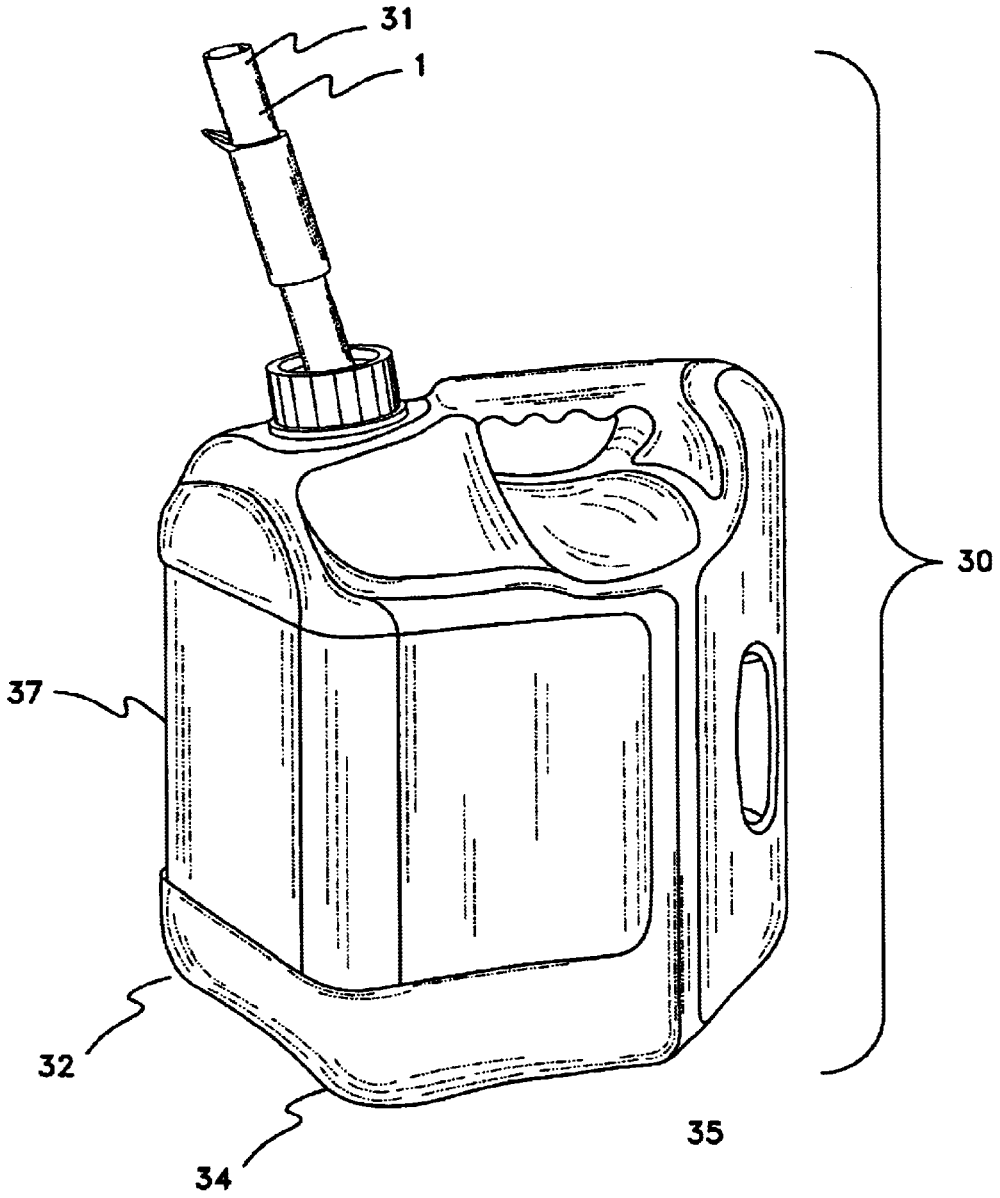
FIG. 11 is a view of a fuel container in a fuel delivery termination orientation, relative to at least one embodiment of the invention.
Figures 12, 12A, 12B, 12C:
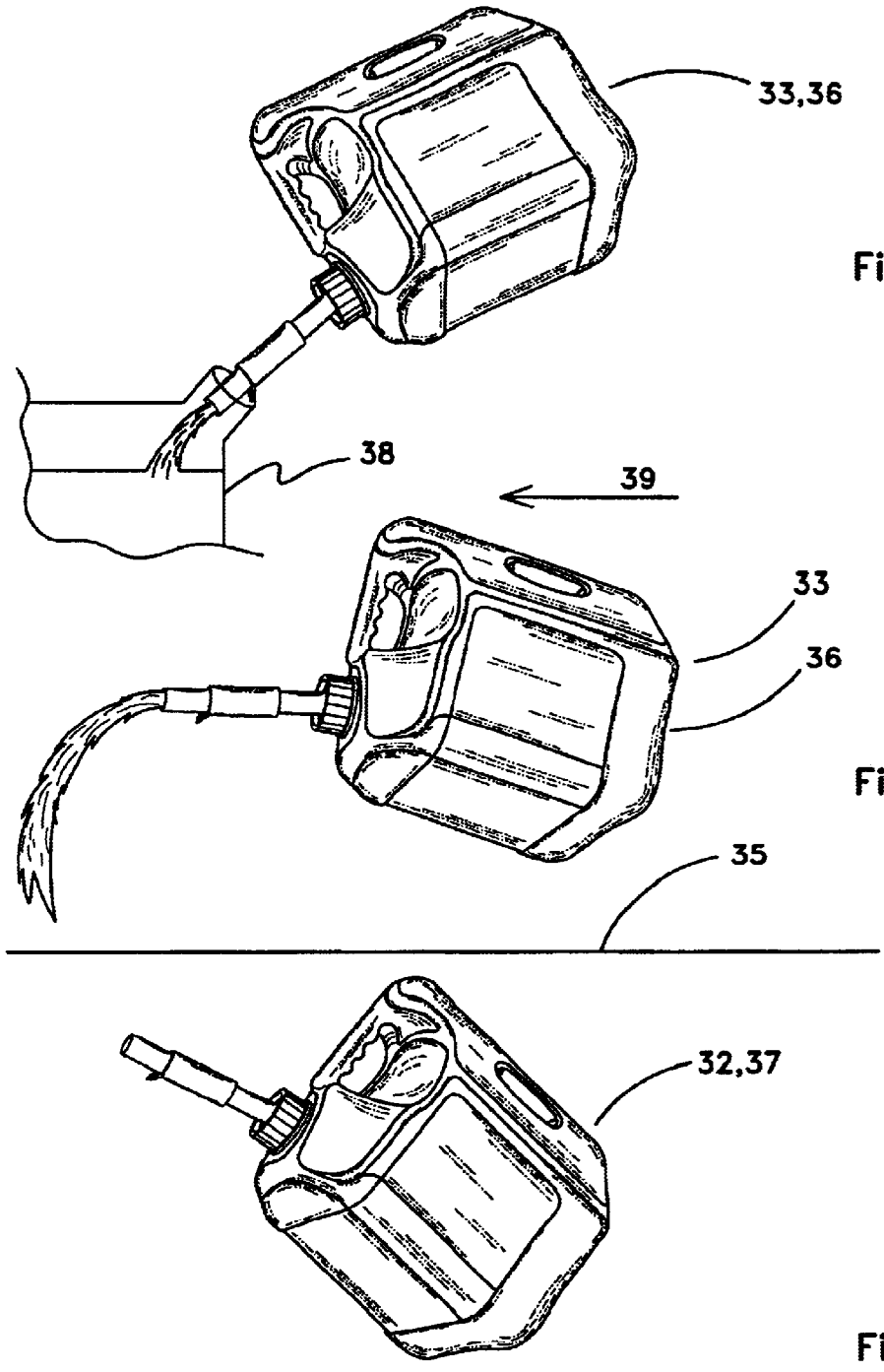
FIGS. 12*a*, 12*b* and 12*c* are views of a fuel container in a fuel delivery orientation (FIGS. 12*a* and 12*b*); a fuel delivery termination orientation (FIG. 12*c*); a fuel container tilt orientation that results in fuel flow (FIGS. 12*a* and 12*b*); and a fuel container tilt orientation that results in substantial termination of flow (FIG. 12*c*), relative to at least one embodiment of the invention.

As shown in FIG. 1, a one way valve (13) may be incorporated in some manner within the inner portion of a fuel conduit (1) of a fuel pump nozzle (2) so that the valve may open and thereby allow fluid flow when such flow is intended and desired, but close when such flow is not intended and not desired, thereby preventing flow in the form of drips or a small stream of fuel from the end of the conduit. The valve (13) may be biased in an upflow direction and thus responsive to a decreased pressure on its upflow face (18), this decreased pressure observable upon an intended termination of the fuel flow as may occur when a main valve element (5) is closed. As shown in FIG. 3, the fuel drip prevention valve element (4) or one way valve (13) may be incorporated into a fuel pump nozzle without involving or requiring a conduit extension (12), or, as shown in FIG. 8, it may be incorporated into a conduit extension (12) which may then be attached in some manner to an unextended fuel conduit. FIGS. 3 and 8 both relate to manners of adapting a fuel nozzle, or creating an adapted fuel conduit (3). As FIGS. 11 and 12 suggest, the inventive method is also applicable to the fuel delivery nozzle (31) of a fuel container (30) such as a gas can.

A fuel pump nozzle drip prevention method may comprise the steps of adapting a fuel conduit (1) of a fuel pump nozzle (2) to create an adapted fuel conduit (3) and to establish a fuel drip prevention valve element (4) within the adapted fuel conduit (3) at a position downflow of a main valve element (5) and towards a fuel source distal, terminal end (6) of the adapted fuel conduit (3). The fuel drip prevention valve element (4) may be responsive to a fuel delivery shut-off condition and reconfigure upon fuel delivery shut-off of the main valve element (5) so as to substantially obstruct the adapted fuel conduit (3), substantially upon the fuel delivery shutoff of the main valve element; the adapted fuel conduit (3) has an inner surface (7) that defines a simple closed curve (8) and a conduit axis (9); and the fuel drip prevention valve element (4) may comprise a first fuel obstruction element (10) that is rotatable about and attached at a first chord (11) of the simple closed curve. In this manner, the method may be used to substantially prevent fuel drips from the fuel source distal, terminal end (6) of the adapted fuel conduit (3) substantially upon the fuel delivery shutoff of the main valve element.

Notably, the term "drip" includes any undesired flow occurring after shutoff of the main valve element (5) (or after reorientation of the fuel container into a fuel delivery termination orientation, as discussed below), even though it may not technically manifest itself as drips (indeed, it may be a thin stream flow that only after some travel through air after discharge from the conduit becomes drips or drops). Additionally, the term "substantially obstruct" includes obstruct just enough to prevent all or most of the drips that otherwise would occur. Further, the term flow or fluid delivery includes flow or fluid conveyance. It is also important to understand that the term "pump" as used in, e.g., fuel or fluid pump nozzle, includes not only a nozzle that delivers fuel or fluid that is pressurized by a pump (e.g., mechanical), but also a nozzle that delivers fuel or fluid that is gravity fed. The term "main valve element" includes a valve that is operable to terminate the majority of the fluid flow, and includes not only those valves that substantially obstruct a fluid conduit, but also any element that is usable to substantially terminate the pressure that, during flow, acts on the upflow side of the fluid drip prevention valve element. As used herein, the term "attached" or "attached at" includes but is not limited to: disengageable and permanent attachments, attachments that allow and enable relative motion of the attached parts, and indirect attachments (as where, there is an intermediate part between the two attached parts), and any type of connection, among other types.

It is important also to understand that the inventor contemplates retrofitting existing fuel pump and delivery nozzles with the drip prevention valve element, in addition to manufacturing fuel pump and delivery nozzles with the drip prevention valve element incorporated therein (such installation is deemed a type of factory adaptation). Retrofitting (e.g. after-market retrofitting, as opposed to factory adaptation), also a type of adaptation, may be either: (a) by installation or insertion of the drip prevention valve element into a fuel conduit (1) that is already part of a fuel nozzle; or (b) by attachment of a fluid conduit extension (12) (threaded engagement (e.g. screw threading), adhesive attachment, bolted attachment, as but a few examples) that has inserted into it (or that can accommodate or allow the insertion of) the drip prevention valve element, as but two examples. Each type is an example of adapting a fuel conduit (1) of a fuel pump nozzle (2) to create an adapted fuel conduit (3) and to establish a fuel drip prevention valve element (4) within the adapted fuel conduit. It should also be noted that the term fuel conduit as used herein may include any conduit through which fuel may flow; it includes adapted and non-adapted fuel conduits. However, the conduit must of course be able to achieve the indicated purpose (e.g., to establish a fuel drip prevention valve element (4) within the adapted fuel conduit). Adaptation is not limited to structural modification of the conduit; indeed, merely a pure addition to an existing, unadapted conduit of a certain part by, e.g., adhesive, is an adaptation of the conduit if the resulting conduit can achieve the purpose that may be indicated.

In "after market" retrofitting (as opposed to factory adaptation), e.g., the step of adapting a fuel conduit (1) of a fuel pump nozzle (2) to create an adapted fuel conduit (3) and to establish a fuel drip prevention valve element (4) within the adapted fuel conduit (3) may comprise the step of attaching a fuel conduit extension (12) via an attachment operation selected from the group consisting of screw threading, adhesive attaching, and bolting (a broad term that includes riveting). The fuel drip prevention valve element (4) may then be somehow inserted into and/or secured within the extension (12) of the adapted conduit, or indeed, the conduit extension (12) may have this valve already inserted into it before attachment of the extension (12). Or, "after market" retrofitting might not involve attachment of a conduit extension, and instead might merely involve insertion of the fuel drip prevention valve element (4) into the existing conduit to create an adapted conduit (as may also be found in factory adaptation) (see FIGS. 1, 4, 9*a* and 9*b*). Whenever the drip prevention valve element is inserted into a conduit to create an adapted conduit (whether as a retrofit or as a factory adaptation), it may be necessary to configure the valve element (4) substantially around any fuel receptacle (e.g., vehicle fuel tank) filled condition sensor that may exist.

In "factory adaptation", the step of adapting a fuel conduit (1) of a fuel pump nozzle (2) to create an adapted fuel conduit (3) and to establish a fuel drip prevention valve element (4) within the adapted fuel conduit (3) may comprise the step of "factory securing" a fuel drip prevention valve element (4) within the fuel conduit (1) (meaning the step is performed before use by a "consumer" or customer such as a gasoline station), whether that fuel conduit (1) is an extension (12) or not.

In a preferred embodiment, the fuel delivery shut-off condition is a fuel delivery shut off pressure. (which may, e.g., be substantially ambient pressure, such as atmospheric). Further, the fuel may be gasoline, diesel, jet fuel or kerosene, as but a few examples. In a preferred embodiment, the fuel drip prevention valve element (4) is a one-way valve (13) and a flapper valve (e.g., a dual flapper valve (14)), but other types of one-way valves are contemplated by the inventor. Regardless of the specific valve type, the fuel drip prevention valve element (4) may be biased in an upflow direction (15) upon establishment within a fuel conduit (1) of a fuel pump nozzle (2); the step of establishing a fuel drip prevention valve element (4) within the adapted fuel conduit (3) at a position downflow of a main valve element (5) and towards a fuel source distal, terminal end (6) of the adapted fuel conduit (3) may comprise the step of biasing the fuel drip prevention valve element (4) in an upflow direction (15). Such biasing may be accomplished by, as but two examples, a spring (16) or other bias element (60) that compels a reconfiguration of the valve element (4) to a fuel conduit obstruction configuration (20) upon experiencing a fuel delivery shut-off condition (such as a fuel delivery shut-off condition pressure immediately upflow of the valve). In such a design, upon flow of the fuel (fuel delivery), the pressure (e.g., impact pressure) acting on an upflow face (18) of the valve element (4) may be greater than that pressure acting on a downflow face (19) of the valve element (4); such pressure gradient may cause reconfiguration of the valve element (4) from a fuel conduit obstruction configuration (20) during fuel delivery shut-off to a fuel conduit flow configuration (45) during fuel delivery, and maintenance of that fuel conduit flow configuration (45) during fuel delivery and until a shut-off condition (e.g., a shut-off pressure) is realized. Importantly, "towards a fuel source distal, terminal end of the adapted fuel conduit" may be substantially at (21) a terminal end (6) of the adapted fuel conduit. Additionally, the term fuel delivery shut-off condition includes a condition that may exist during the time where, but for the fuel drip prevention valve element, drips may exit the end of the fuel conduit (1). Such term is, at least in a one embodiment of the present invention, most related to the closing of the main valve element. In at least one embodiment, the fuel drip prevention valve element (4) may further comprise a second flow obstruction element (22) that is rotatable about and attached at a second chord (23) of the simple closed curve. Additionally, the first chord (11) and the second chord (23) may each be contained within a plane that is orthogonal to the conduit axis (9), the first and second chords may be collinear, and the first and second chords may bisect the simple closed curve.

At least one embodiment of the invention may include a "seat" (50) or other obstructive type part (51) that acts to oppose or obstruct upflow movement of the flow obstruction element(s) (which, again, is "upflow biased" in a preferred embodiment) past a certain point, thus limiting the range of arc through which the flow obstruction element(s) may pass. The obstructive type part may be an internal collar type seat or other type of obstruction disposed on the inner surface (7) of the conduit, a sufficiently smaller diameter of the inner surface (7) of the conduit upflow of the drip prevention valve element (see FIGS. 1 and 4, e.g.), or a structure that is most correctly referred to as a part of the drip prevention valve element.

In at least one embodiment, a fuel pump nozzle drip prevention method may comprise the steps of establishing a fuel source distal, terminal end (6) of a fuel conduit (1) of a fuel pump nozzle (2) in a fuel delivery receptacle (24) (where the fuel conduit (1) may have an inner surface (7) that defines a simple closed curve (8) and a conduit axis (9)); operating a main fuel flow valve element to initiate delivery of fuel (25) through the fuel conduit (1); reconfiguring a fuel drip prevention valve element (4) that itself may comprise at least a first fuel obstruction element (10) from a fuel conduit obstruction configuration (20) to a fuel conduit flow configuration (45); flowing fuel from a fuel source (26) through the fuel conduit (1) and into the fuel delivery receptacle (24); operating the main fuel flow valve element to substantially terminate the step of flowing fuel from a fuel source (26) through the fuel conduit (1) and into the fuel delivery receptacle (24); reconfiguring the fuel drip prevention valve element (4) from the fuel conduit flow configuration (45) to the fuel conduit obstruction configuration (20); and, by performing the step of reconfiguring the fuel drip prevention valve element (4) from the fuel conduit flow configuration (45) to the fuel conduit obstruction configuration (20), substantially preventing fuel drips from the fuel source distal, terminal end (6) of the fuel conduit (1). Note that reconfiguring includes causing reconfiguration of, in any manner (as, indeed, any active verb may be performed by causing the indicated action, in any manner), either directly or indirectly. The step of reconfiguring the fuel drip prevention valve element (4) from the fuel conduit flow configuration (45) to the fuel conduit obstruction configuration (20) may comprise the step of rotating the first fuel obstruction element (10) about a first chord (11) of the simple closed curve, and the first fuel obstruction element (10) may be attached at the first chord. This step of reconfiguring may also comprise the step of rotating a second flow obstruction element (22) about a second chord (23) of the simple closed curve. In a preferred embodiment, the first and the second chord (23) are each contained within a plane that is orthogonal to the conduit axis (9), the first and the second chords may be collinear, and the chords may bisect the simple closed curve (8). Additionally, the step "substantially terminate the step of flowing fuel from a fuel source (26) through the fuel conduit (1) and into the fuel delivery receptacle" is to be understood to be performed even where, but for the fuel drip prevention valve element, fuel drips (including small stream flow) exit from a conduit opening or end that is downflow of the main valve element. Similar uses of the term "substantially terminate flow" throughout the application may be understood to be as broad.

In at least one embodiment of the invention, the fuel delivery receptacle (24) is either a motorized vehicle fuel tank or an airplane fuel tank, and, as such, the step of operating a main fuel flow valve element to initiate delivery of fuel (25) comprises the step of squeezing a fuel pump nozzle trigger (27). Likewise, the step of operating the main fuel flow valve element to substantially terminate the step of flowing fuel from a fuel source (26) through the fuel conduit (1) and into the fuel delivery receptacle (24) may comprise the step of releasing a trigger of the fuel pump nozzle (2) (of course, this step can be accomplished manually or automatically, as but two examples; automatic operation of the main fuel flow valve element to substantially terminate the step of flowing fuel can occur, e.g., where a main fuel flow valve element of a fuel pump nozzle (2) automatically closes upon the fuel delivery receptacle (24) (e.g., a vehicle fuel tank) reaches a full condition).

Further, in at least one embodiment of the invention, the step of reconfiguring a fuel drip prevention valve element (4) from a fuel conduit obstruction configuration (20) to a fuel conduit flow configuration (45) comprises the step of reconfiguring the fuel drip prevention valve element (4) against a bias force, a step which itself may involve folding the fuel drip prevention valve element (4) substantially in half. In at least one embodiment of the invention, the step of reconfiguring the fuel drip prevention valve element (4) from the fuel conduit flow configuration (45) to the fuel conduit obstruction configuration (20) comprises the step of reconfiguring the fuel drip prevention valve element (4) from a substantially nonplanar configuration (28) to a substantially planar configuration (29). The step of reconfiguring a fuel drip prevention valve element (4) from a fuel conduit obstruction configuration (20) to a fuel conduit flow configuration (45) may occur substantially while performing the step of operating the main valve flow element to initiate delivery of fuel (25) through the fuel conduit (1). In at least one embodiment of the invention, reconfiguring the fuel drip prevention valve element (4) from the fuel conduit flow configuration (45) to the fuel conduit obstruction configuration (20) may occur substantially while performing the step of operating the main valve flow element to substantially terminate the step of flowing fuel.

A fuel delivery nozzle drip prevention method for, e.g., delivery of fuel from a fuel container (30) that does not have a pump (such as a two gallon gas container for lawn mower use, as but one example) nor a main valve element, may comprise the steps of adapting a fuel conduit (1) of a fuel delivery nozzle (31) of a fuel container (30) to create an adapted fuel conduit (3) and to establish a fuel drip prevention valve element (4) within said adapted fuel conduit (3) at a position towards a fuel source distal, terminal end (6) of the adapted fuel conduit. The fuel drip prevention valve element (4) is reconfigurably responsive to a fuel delivery condition achieved upon reorientation of a fuel source container from a fuel delivery termination orientation (32) to a fuel delivery orientation (33) so as to allow fuel flow, and the fuel drip prevention valve element (4) is reconfigurably responsive to a fuel delivery termination condition so as to substantially obstruct the adapted fuel conduit (3) upon reorientation of the fuel source container from the fuel delivery orientation (33) to the fuel delivery termination orientation (32). Further, the adapted fuel conduit (3) may have an inner surface (7) that defines a simple closed curve (8) and a conduit axis (9), and the fuel drip prevention valve element (4) may comprise a first fuel obstruction element (10) that is rotatable about and perhaps attached at a first chord (11) of the simple closed curve. It is important to note that the fuel drip prevention valve element (4) may further comprise a second flow obstruction element (22) that is rotatable about and attached at a second chord (23) of the simple closed curve (8), the first and second chords may each be contained within a plane that is orthogonal to the conduit axis (9), the first and second chords may be collinear, and the chords may bisect the simple closed curve (8). Fuel drips from the fuel source distal, terminal end (6) of the adapted fuel conduit (3) may be substantially prevented upon reorientation of the fuel source container to the fuel delivery termination orientation (32) by following the steps of this method. Notably, the "fuel delivery termination orientation" includes any container orientation that does not result in flow from the container, ignoring the effects of any fuel drip prevention valve element (4) that may be in use. It includes the case where the container is oriented with a flat bottom surface (34) on, e.g., a horizontal ground surface (35), and the case where the container is sufficiently tilted back to end any flow from it (again ignoring the effects of any fuel drip prevention valve element (4) in use).

The adaptation of the fuel conduit (1) of a fuel delivery nozzle (31) may be either a retrofitting operation or a factory adaptation. In the case of retrofitting (e.g., after market), the step of adapting a fuel conduit (1) of a fuel delivery nozzle (31) of a fuel container (30) to create an adapted fuel conduit (3) and to establish a fuel drip prevention valve element (4) within said adapted fuel conduit (3) may comprise the step of attaching a fuel conduit extension (12) via an attachment operation selected from the group consisting of screw threading, adhesive attaching, and bolting (including riveting). Retrofitting may also simply involve inserting a fuel drip prevention valve element (4) into and/or securing a fuel drip prevention valve element (4) within an existing fuel conduit (1) to create a "non-extended", adapted fuel conduit.

In the case of "factory adaptation" of a fuel delivery nozzle (31), the step of adapting a fuel conduit (1) of a fuel delivery nozzle (31) to create an adapted fuel conduit (3) and to establish a fuel drip prevention valve element (4) within the adapted fuel conduit (3) may comprise the step of "factory securing" a fuel drip prevention valve element (4) within the fuel conduit (1) (meaning the step is performed before use by consumer such as a gasoline station), whether that fuel conduit (1) is an extension (12) or not.

In at least one embodiment of the invention, the step of adapting a fuel conduit (1) of a fuel delivery nozzle (31) of a fuel container (30) to create an adapted fuel conduit (3) and to establish a fuel drip prevention valve element (4) within said adapted fuel conduit (3) may comprise the step of biasing the fuel drip prevention valve element (4) in an upflow direction (15). Further, in at least one embodiment of the invention, the fuel delivery condition is a fuel delivery pressure, and the fuel delivery termination condition is a fuel delivery termination pressure. The text "towards a fuel source distal, terminal end of the adapted fuel conduit" may comprise at or substantially at a terminal end (6) of the adapted fuel conduit. Fuel delivery termination pressure may include, but is certainly not limited to, a pressure that initiates fuel delivery termination.

Importantly, the fuel delivery orientation (33) may be a fuel container tilt orientation (36) that results in fuel flow out of the fuel source distal, terminal end (6) of the adapted fuel conduit, and the fuel delivery termination orientation (32) is a fuel container tilt orientation (37) that results in substantial termination of fuel flow out of the fuel source distal, terminal end (6) of the adapted fuel conduit.

A fuel delivery nozzle drip prevention method may comprise the steps of establishing a fuel source distal, terminal end (6) of a fuel conduit (1) of a fuel delivery nozzle (31) of a fuel container (30) in a fuel delivery receptacle (24) (where the fuel conduit (1) has an inner surface (7) that defines a simple closed curve (8) and a conduit axis (9)); reorienting the fuel container (30) from a fuel delivery termination orientation (32) to a fuel delivery orientation (33) to initiate delivery of fuel (25) through at least a portion of the fuel conduit (1); reconfiguring a fuel drip prevention valve element (4) that comprises at least a first fuel obstruction element (10) from a fuel conduit obstruction configuration (20) to a fuel conduit flow configuration (45); flowing fuel from a fuel source (26) through the fuel source distal, terminal end (6) of the fuel conduit (1) and into the fuel delivery receptacle (24); reorienting the fuel container (30) from the fuel delivery orientation (33) to the fuel delivery termination orientation (32) so as to substantially terminate the step of flowing fuel from a fuel source (26) through the fuel source distal, terminal end (6) of the conduit and into the fuel delivery receptacle (24); reconfiguring the fuel drip prevention valve element (4) from the fuel conduit flow configuration (45) to the fuel conduit obstruction configuration; and substantially preventing fuel drips from the fuel source distal, terminal end (6) of the fuel conduit (1). The step of reconfiguring the fuel drip prevention valve element (4) from the fuel conduit flow configuration (45) to the fuel conduit obstruction configuration may comprise the step of rotating the first fuel obstruction element (10) about a first chord (11) of the simple closed curve, and the first fuel obstruction element (10) may be attached at the first chord. This step of reconfiguring may further comprise rotating a second fuel obstruction element about a second chord (23) of the simple closed curve., where the first and second chords may be each contained within a plane that is orthogonal to the conduit axis (9), the two chords may be collinear, and the two chords may bisect the simple closed curve.

In at least one embodiment of the invention, the fuel delivery receptacle (24) is either a motorized vehicle fuel tank, an airplane fuel tank, a motorized farm equipment or motorized lawn equipment. Further, the step of reorienting the fuel container (30) from a fuel delivery termination orientation (32) to a fuel delivery orientation (33)to initiate delivery of fuel (25) through at least a portion of the fuel conduit (1) may comprise tilting the fuel container forwards (39) sufficiently to cause fuel flow through at least a portion of the fuel conduit (1). The step of reconfiguring a fuel drip prevention valve element (4) from a fuel conduit obstruction configuration (20) to a fuel conduit flow configuration (45) may comprise the step of reconfiguring the fuel drip prevention valve element (4) against a bias force, a step which itself may comprise folding the fuel drip prevention valve element (4) substantially in half; reconfiguring the fuel drip prevention valve element (4) from the fuel conduit flow configuration (45) to the fuel conduit obstruction configuration may comprise reconfiguring the fuel drip prevention valve element (4) from a substantially folded position to a substantially planar position. The step of reconfiguring a fuel drip prevention valve element (4) from a fuel conduit obstruction configuration (20) to a fuel conduit flow configuration (45) may occur substantially after performing the step of reorienting the fuel container (30) to a fuel delivery orientation (33) to initiate delivery of fuel (25) through at least a portion of the fuel conduit (1). The step of reorienting the fuel container (30) from a fuel delivery orientation (33) to the fuel delivery termination orientation (32) so as to substantially terminate the step of flowing fuel from a fuel source (26) through the fuel source distal, terminal end (6) of the fuel conduit (1) and into the fuel delivery receptacle (24) may comprise the step of tilting the fuel container (30) backwards sufficiently to terminate fuel flow through the fuel source distal, terminal end (6) of the fuel conduit (1). The step of substantially preventing fuel drips from the fuel source distal, terminal end (6) of the fuel conduit (1) may start upon performing the step of reconfiguring the fuel drip prevention valve element (4) from the fuel conduit flow configuration (45) to the fuel conduit obstruction configuration (20). Further, the step of reconfiguring the fuel drip prevention valve element (4) from the fuel conduit flow configuration (45) to the fuel conduit obstruction configuration (20) may occur upon performing the step of reorienting the fuel container (30) from the fuel delivery orientation (33) to the fuel delivery termination orientation (32) so as to substantially terminate the step of flowing fuel from a fuel source (26) through the fuel source distal, terminal end (6) of the conduit and into the fuel delivery receptacle (24).

It is important to understand a Step A is performed "substantially while performing" a Step B where the two steps are performed simultaneously or nearly simultaneously. For example, a step is considered to be performed substantially while another step is performed even though there is a difference in the time of performance of step two due to travel time of a pressure wave.

It is also important to understand that the invention encompasses not only a new method usable with fuel conveyance devices, but also more generally with fluid conveyance devices. Thus, each instance of the word "fuel" as used above to describe embodiment(s) of the invention may be replaced with the term "fluid", thereby describing a broader invention usable to prevent drops after an intended shut-off of fluid flow by closing the main valve element. For example, the fuel drip prevention valve element, upon said replacement, becomes the fluid drip prevention valve element.

As can be easily understood from the foregoing, the basic concepts of the present invention may be embodied in a variety of ways. It involves both flow prevention techniques as well as devices to accomplish the appropriate flow prevention. In this application, the flow prevention techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Neither the description nor the terminology is intended to limit the scope of the claims which will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon for support of the claims.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "receptacle" should be understood to encompass disclosure of the act of "receiving" —whether explicitly discussed or not—and, conversely, were there effectively disclosure of the act of "receiving", such a disclosure should be understood to encompass disclosure of a "receptacle" and even a "means for receiving" Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information disclosure statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant (s).

Thus, the applicant(s) should be understood to have support to claim and make a statement of invention to at least: i) each of the fluid drip prevention devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A fuel pump nozzle drip prevention method comprising the steps of:

adapting a fuel conduit of a fuel pump nozzle:

to create an adapted fuel conduit; and to establish a fuel drip prevention valve element within said adapted fuel conduit at a position downflow of a main valve element and towards a fuel source distal, terminal end of said adapted fuel conduit, wherein said fuel drip prevention valve element is responsive to a fuel delivery shut-off condition and reconfigures upon fuel delivery shut-off of said main valve element so as to substantially obstruct said adapted fuel conduit substantially upon said fuel delivery shutoff of said main valve element, thereby substantially preventing fuel drips from said fuel source distal, terminal end of said adapted fuel conduit substantially upon said fuel delivery shutoff of said main valve element, wherein said adapted fuel conduit has an inner surface that defines a simple closed curve and a conduit axis, and wherein said fuel drip prevention valve element comprises a first fuel obstruction element that is rotatable about and attached at a first chord of said simple closed curve.

2. A fuel pump nozzle drip prevention method as described in claim 1 wherein said fuel is selected from the group consisting of: gasoline, diesel, jet fuel and kerosene.

3. A fuel pump nozzle drip prevention method as described in claim 1 wherein said fuel drip prevention valve element comprises a one way valve.

4. A fuel pump nozzle drip prevention method as described in claim 1 or 3 wherein said fuel drip prevention valve element comprises a dual flapper valve.

5. A fuel pump nozzle drip prevention method as described in claim 4 wherein said step of establishing a fuel drip prevention valve element within said adapted fuel conduit comprises the step of biasing said fuel drip prevention valve element in an upflow direction.

6. A fuel pump nozzle drip prevention method as described in claim 1 wherein said fuel delivery shut-off condition is a fuel delivery shut-off pressure.

7. A fuel pump nozzle drip prevention method as described in claim 1 wherein towards a fuel source distal, terminal end of said adapted fuel conduit comprises substantially at said terminal end.

8. A fuel pump nozzle drip prevention method as described in claim 1 wherein said fuel drip prevention valve element further comprises a second fuel obstruction element that is rotatable about and attached at a second chord of said simple closed curve.

9. A fuel pump nozzle drip prevention method as described in claim 8 wherein said first chord and said second chord are each contained within a plane that is orthogonal to said conduit axis.

10. A fuel pump nozzle drip prevention method as described in claim 9 wherein said first chord and said second chord are substantially collinear.

11. A fuel pump nozzle drip prevention method as described in claim 10 wherein said first chord and said second chord bisect said simple closed curve.

12. A fuel pump nozzle created by practicing the method of any of claim 1, 8, 9 or 11.

13. A fuel pump nozzle drip prevention method as described in claim 1 wherein said step of adapting a fuel conduit of a fuel pump nozzle to create an adapted fuel conduit and to establish a fuel drip prevention valve element within said adapted fuel conduit comprises the step of attaching a fuel conduit extension via an attachment operation selected from the group consisting of screw threading, adhesive attaching, and bolting.

14. A fuel pump nozzle drip prevention method as described in claim 1 wherein said step of adapting a fuel conduit of a fuel pump nozzle to create an adapted fuel conduit and to establish a fuel drip prevention valve element within said adapted fuel conduit comprises the step of factory securing a fuel drip prevention valve element within said fuel conduit.

15. A fuel pump nozzle drip prevention method comprising the steps of:

establishing a fuel source distal, terminal end of a fuel conduit of a fuel pump nozzle in a fuel delivery receptacle;

wherein said fuel conduit has an inner surface that defines a simple closed curve and a conduit axis, operating a main fuel flow valve element to initiate delivery of fuel through said fuel conduit;

reconfiguring a fuel drip prevention valve element that comprises at least a first fuel obstruction element from a fuel conduit obstruction configuration to a fuel conduit flow configuration;

flowing fuel from a fuel source through said fuel conduit and into said fuel delivery receptacle;

operating said main fuel flow valve element to substantially terminate said step of flowing fuel from a fuel source through said fuel conduit and into said fuel delivery receptacle;

reconfiguring said fuel drip prevention valve element from said fuel conduit flow configuration to said fuel conduit obstruction configuration; and substantially preventing fuel drips from said fuel source distal, terminal end of said fuel conduit by performing said step of reconfiguring said fuel drip prevention valve element from said fuel conduit flow configuration to said fuel conduit obstruction configuration, wherein said step of reconfiguring said fuel drip prevention valve element from said fuel conduit flow configuration to said fuel conduit obstruction configuration comprises the step of rotating said first fuel obstruction element about a first chord of said simple closed curve, and wherein said first fuel obstruction element is attached at said first chord.

16. A fuel pump nozzle drip prevention method as described in claim 15 wherein said fuel delivery receptacle comprises an element selected from group consisting of: motorized vehicle fuel tank and airplane fuel tank.

17. A fuel pump nozzle drip prevention method as described in claim 15 wherein said step of operating a main fuel flow valve element to initiate delivery of fuel comprises the step of squeezing a fuel pump nozzle trigger.

18. A fuel pump nozzle drip prevention method as described in claim 15 wherein said step of reconfiguring a fuel drip prevention valve element from a fuel conduit obstruction configuration to a fuel conduit flow configuration comprises the step of reconfiguring said fuel drip prevention valve element against a bias force.

19. A fuel pump nozzle drip prevention method as described in claim 18 wherein said step of reconfiguring said fuel drip prevention valve element against a bias force comprises the step of folding said fuel drip prevention valve element substantially in half.

20. A fuel pump nozzle drip prevention method as described in claim 15 wherein said step of operating said main fuel flow valve element to substantially terminate said step of flowing fuel from a fuel source through said fuel conduit and into said fuel delivery receptacle comprises the step of releasing a trigger of said fuel pump nozzle.

21. A fuel pump nozzle drip prevention method as described in claim 15 wherein said step of reconfiguring said fuel drip prevention valve element from said fuel conduit flow configuration to said fuel conduit obstruction configuration comprises the step of reconfiguring said fuel drip prevention valve element from a substantially nonplanar configuration to a substantially planar configuration.

22. A fuel pump nozzle drip prevention method as described in claim 15 wherein said fuel comprises a fuel selected from the group consisting of: gasoline, diesel fuel, jet fuel and kerosene.

23. A fuel pump nozzle drip prevention method as described in claim 15 wherein said step of reconfiguring a fuel drip prevention valve element from a fuel conduit obstruction configuration to a fuel conduit flow configuration occurs substantially while performing said step of operating said main valve flow element to initiate delivery of fuel through said fuel conduit.

24. A fuel pump nozzle drip prevention method as described in claim 15 wherein said step of reconfiguring said fuel drip prevention valve element from said fuel conduit flow configuration to said fuel conduit obstruction configuration occurs substantially while performing said step of operating said main valve flow element to substantially terminate said step of flowing fuel.

25. A fuel pump nozzle drip prevention method as described in claim 15 wherein said step of reconfiguring said fuel drip prevention valve element from said fuel conduit flow configuration to said fuel conduit obstruction configuration further comprises the step of rotating a second fuel obstruction element about a second chord of said simple closed curve.

26. A fuel pump nozzle drip prevention method as described in claim 25 wherein said first chord and said second chord are each contained within a plane that is orthogonal to said conduit axis.

27. A fuel pump nozzle drip prevention method as described in claim 26 wherein said first chord and said second chord are substantially collinear.

28. A fuel pump nozzle drip prevention method as described in claim 27 wherein said first chord and said second chord bisect said simple closed curve.

29. A fuel pump nozzle drip prevention method as described in claim 15 wherein said fuel drip prevention valve element comprises a dual flapper valve.

30. The fuel pump nozzle used in the method of any of claim 15, 25, 27 or 29.

31. A fuel delivery nozzle drip prevention method comprising the steps of:

adapting a fuel conduit of a fuel delivery nozzle of a fuel container:

(a) to create an adapted fuel conduit; and (b) to establish a fuel drip prevention valve element within said adapted fuel conduit at a position towards a fuel source distal, terminal end of said adapted fuel conduit;

wherein said fuel drip prevention valve element is reconfigurably responsive to:

(a) a fuel delivery condition achieved upon reorientation of a fuel source container from a fuel delivery termination orientation to a fuel delivery orientation so as to allow fuel flow, and (b) a fuel delivery termination condition so as to substantially obstruct said adapted fuel conduit upon reorientation of said fuel source container from said fuel delivery orientation to said fuel delivery termination orientation, thereby substantially preventing fuel drips from said fuel source distal, terminal end of said adapted fuel conduit upon said reorientation of said fuel source container to said fuel delivery termination orientation, and wherein said adapted fuel conduit has an inner surface that defines a simple closed curve and a conduit axis, and wherein said fuel drip prevention valve element comprises a first flow obstruction element that is rotatable about and attached at a first chord of said simple closed curve.

32. A fuel delivery nozzle drip prevention method as described in claim 31 wherein said fuel is selected from the group consisting of: gasoline, diesel, jet fuel and kerosene.

33. A fuel delivery nozzle drip prevention method as described in claim 31 wherein said fuel drip prevention valve element comprises a one way valve.

34. A fuel delivery nozzle drip prevention method as described in claim 31 or 33 wherein said fuel drip prevention valve element comprises a dual flapper valve.

35. A fuel delivery nozzle drip prevention method as described in claim 34 wherein said step of adapting a fuel conduit of a fuel delivery nozzle of a fuel container to create an adapted fuel conduit; and to establish a fuel drip prevention valve element within said adapted fuel conduit comprises the step of biasing said fuel drip prevention valve element in an upflow direction.

36. A fuel delivery nozzle drip prevention method as described in claim 31 wherein said fuel delivery condition is a fuel delivery pressure.

37. A fuel delivery nozzle drip prevention method as described in claim 31 wherein said fuel delivery termination condition is a fuel delivery termination pressure.

38. A fuel delivery nozzle drip prevention method as described in claim 31 wherein towards a fuel source distal, terminal end of said adapted fuel conduit comprises substantially at a terminal end of said adapted fuel conduit.

39. A fuel delivery nozzle drip prevention method as described in claim 31 wherein said fuel delivery orientation is a fuel container tilt orientation that results in fuel flow out of said fuel source distal, terminal end of said adapted fuel conduit.

40. A fuel delivery nozzle drip prevention method as described in claim 31 wherein said fuel delivery termination orientation is a fuel container tilt orientation that results in substantial termination of fuel flow out of said fuel source distal, terminal end of said adapted fuel conduit.

41. A fuel delivery nozzle drip prevention method as described in claim 31 wherein said fuel drip prevention valve element further comprises a second fuel obstruction element that is rotatable about and attached at a second chord of said simple closed curve.

42. A fuel delivery nozzle drip prevention method as described in claim 41 wherein said first chord and said second chord arc each contained within a plane that is orthogonal to said conduit axis.

43. A fuel delivery nozzle drip prevention method as described in claim 42 wherein said first chord and said second chord are substantially collinear.

44. A fuel delivery nozzle drip prevention method as described in claim 43 wherein said first chord and said second chord bisect said simple closed curve.

45. The fuel container nozzle created by practicing the method of any of claim 31, 41 or 44.

46. A fuel delivery nozzle drip prevention method as described in claim 31 wherein said step of adapting a fuel conduit of a fuel delivery nozzle of a fuel container to create an adapted fuel conduit and to establish a fuel drip prevention valve element within said adapted fuel conduit comprises the step of attaching a fuel conduit extension via an attachment operation selected from the group consisting of screw threading, adhesive attaching, and bolting.

47. A fuel delivery nozzle drip prevention method as described in claim 31 wherein said step of adapting a fuel conduit of a fuel delivery nozzle of a fuel container to create an adapted fuel conduit and to establish a fuel drip prevention valve element within said adapted fuel conduit comprises the step of factory securing a fuel drip prevention valve element within said fuel conduit.

48. A fuel delivery nozzle drip prevention method comprising the steps of:

establishing a fuel source distal, terminal end of a fuel conduit of a fuel delivery nozzle of a fuel container in a fuel delivery receptacle;

wherein said fuel conduit has an inner surface that defines a simple closed curve and a conduit axis, reorienting said fuel container from a fuel delivery termination orientation to a fuel delivery orientation to initiate delivery of fuel through at least a portion of said fuel conduit;

reconfiguring a fuel drip prevention valve element that comprises at least a first fuel obstruction element from a fuel conduit obstruction configuration to a fuel conduit flow configuration;

flowing fuel from a fuel source through said fuel source distal, terminal end of said fuel conduit and into said fuel delivery receptacle;

reorienting said fuel container from said fuel delivery orientation to said fuel delivery termination orientation so as to substantially terminate said step of flowing fuel from a fuel source through said fuel source distal, terminal end of said conduit and into said fuel delivery receptacle;

reconfiguring said fuel drip prevention valve element from said fuel conduit flow configuration to said fuel conduit obstruction configuration;

substantially preventing fuel drips from said fuel source distal, terminal end of said fuel conduit, wherein said step of reconfiguring said fuel drip prevention valve element from said fuel conduit flow configuration to said fuel conduit obstruction configuration comprises the step of rotating said first fuel obstruction element about a first chord of said simple closed curve, and wherein said first fuel obstruction element is attached at said first chord.

49. A fuel delivery nozzle drip prevention method as described in claim 48 wherein said fuel delivery receptacle comprises an element selected from group consisting of: motorized vehicle fuel tank, airplane fuel tank, motorized farm equipment fuel tank, and motorized lawn equipment fuel tank.

50. A fuel delivery nozzle drip prevention method as described in claim 48 wherein said step of reorienting said fuel container from a fuel delivery termination orientation to a fuel delivery orientation to initiate delivery of fuel through at least a portion of said fuel conduit comprises the step of tilting said fuel container forwards sufficiently to cause fuel flow through said at least a portion of said fuel conduit.

51. A fuel delivery nozzle drip prevention method as described in claim 48 wherein said step of reconfiguring a fuel drip prevention valve element from a fuel conduit obstruction configuration to a fuel conduit flow configuration comprises the step of reconfiguring said fuel drip prevention valve element against a bias force.

52. A fuel delivery nozzle drip prevention method as described in claim 51 wherein said step of reconfiguring said fuel drip prevention valve element against a bias force comprises the step of folding said fuel drip prevention valve element substantially in half.

53. A fuel delivery nozzle drip prevention method as described in claim 48 wherein said step of reorienting said fuel container from a fuel delivery orientation to said fuel delivery termination orientation so as to substantially terminate said step of flowing fuel from a fuel source through said fuel source distal, terminal end of said fuel conduit and into said fuel delivery receptacle comprises the step of tilting said fuel container backwards sufficiently to terminate fuel flow through said fuel source distal, terminal end of said fuel conduit.

54. A fuel delivery nozzle drip prevention method as described in claim 48 wherein said step of reconfiguring said fuel drip prevention valve element from said fuel conduit flow configuration to said fuel conduit obstruction configuration comprises the step of reconfiguring said fuel drip prevention valve element from a substantially folded position to a substantially planar position.

55. A fuel delivery nozzle drip prevention method as described in claim 48 wherein said fuel is selected from the group consisting of: gasoline, diesel fuel, jet fuel, and kerosene.

56. A fuel delivery nozzle drip prevention method as described in claim 48 wherein said step of reconfiguring a fuel drip prevention valve element from a fuel conduit obstruction configuration to a fuel conduit flow configuration occurs substantially after performing said step of reorienting said fuel container to a fuel delivery orientation to initiate delivery of fuel through at least a portion of said fuel conduit.

57. A fuel delivery nozzle drip prevention method as described in claim 48 wherein said step of substantially preventing fuel drips from said fuel source distal, terminal end of said fuel conduit is initiated upon performing said step of reconfiguring said fuel drip prevention valve element from said fuel conduit flow configuration to said fuel conduit obstruction configuration.

58. A fuel delivery nozzle drip prevention method as described in claim 48 wherein said step of reconfiguring said fuel drip prevention valve element from said fuel conduit flow configuration to said fuel conduit obstruction configuration occurs upon performing said step of reorienting said fuel container from said fuel delivery orientation to said fuel delivery termination orientation so as to substantially terminate said step of flowing fuel from a fuel source through said fuel source distal, terminal end of said conduit and into said fuel delivery receptacle.

59. A fuel delivery nozzle drip prevention method as described in claim 48 wherein said step of reconfiguring said fuel drip prevention valve element from said fuel conduit flow configuration to said fuel conduit obstruction configuration further comprises the step of rotating a second fuel obstruction element about a second chord of said simple closed curve.

60. A fuel pump nozzle drip prevention method as described in claim 59 wherein said first chord and said second chord are each contained within a plane that is orthogonal to said conduit axis.

61. A fuel pump nozzle drip prevention method as described in claim 60 wherein said first chord and said second chord are substantially collinear.

62. A fuel pump nozzle drip prevention method as described in claim 61 wherein said first chord and said second chord bisect said simple closed curve.

63. A fuel pump nozzle drip prevention method as described in claim 48 wherein said fuel drip prevention valve element comprises a dual flapper valve.

64. The fuel container, nozzle and valve element of any of claim 48 or 59.

* * * * *